US005149316A

United States Patent [19]

Cappi et al.

[11] Patent Number: 5,149,316

[45] Date of Patent: Sep. 22, 1992

[54] DIE CUTTING AND WELDING DEVICE FOR AN ON-DEMAND BAG FORMING MACHINE INCORPORATED IN A CHECKOUT COUNTER

[75] Inventors: Angelo Cappi, Vignola; Renato Rimondi, Bazzano, both of Italy

[73] Assignee: A.W.A.X. Progettazione E Ricerca S.R.L., Vignola, Italy

[21] Appl. No.: 669,908

[22] Filed: Mar. 15, 1991

[30] Foreign Application Priority Data

Mar. 15, 1990 [IT] Italy ..... 19692 A/90

[51] Int. Cl.[5] ..... B31B 1/16; B31B 1/64

[52] U.S. Cl. ..... 493/194; 493/239; 493/203

[58] Field of Search ..... 493/186, 189, 193-196, 493/198-201, 203, 206, 209, 227, 230, 233, 235, 238-239, 341, 363, 366, 372, 475, 478, 926; 83/571, 572, 573

[56] References Cited

U.S. PATENT DOCUMENTS

| | | | |
|---|---|---|---|
| 3,574,039 | 4/1971 | Fehr et al. | 493/203 X |
| 4,909,356 | 3/1990 | Rimondi et al. | 493/926 X |
| 5,015,223 | 5/1991 | Boeckmann | 493/194 |

*Primary Examiner*—Bruce M. Kisliuk
*Assistant Examiner*—John A. Marlott
*Attorney, Agent, or Firm*—Cohen, Pontani, Lieberman & Pavane

[57] ABSTRACT

A welding and die cutting device for an apparatus for automatically forming bags on demand from an elongated web of film is selectively switchable between a first operating mode in which the formed bags are provided with unitary handles and a second operating mode in which the formed bags are fully closed and no handles are formed thereon. A first one of a pair of reciprocatable mobile holders carries a welding counter-plate to which is mounted a horizontal blade for transverse cutting and separation of formed bags from the web. A plurality of substantially vertical blades for longitudinally cutting the web to form handles on a bag being formed are carried on and depend outwardly from a bladeholder that is interposed between the first mobile holder and the counter-plate. The bladeholder is slidably and elastically linked to the first mobile holder for movement therewith and relative thereto. A pivotally rotatable spacer element is selectively pivotable between a first position in which it interposingly maintains a predetermined separation between the bladeholder and first mobile holder to enable handle-forming engagement of the second blades with the film web and a second position enabling substantial abutment of the bladeholder and first mobile holder to thereby prevent handle-forming contact of the second blades with the web.

13 Claims, 3 Drawing Sheets

DIE CUTTING AND WELDING DEVICE FOR AN ON-DEMAND BAG FORMING MACHINE INCORPORATED IN A CHECKOUT COUNTER

FIELD OF THE INVENTION

The present invention relates to apparatus for die cutting and welding plastic bags in automatic bagging or packing or bag forming machines at the check-out counters of supermarkets and the like and, more particularly, to such apparatus for on-demand provision of, at the option of the user, either bags incorporating unitary handles or handleless, fully-closed bags.

BACKGROUND OF THE INVENTION

Automatic bagging or packing or bag forming machines incorporated in the checkout counters of supermarkets and the like are known, as for example disclosed in commonly-owned Italian Patent No. 1,203,342. Such machines are operable for on-demand bagging of customer purchased articles in machine-formed handled bags in the case of some machines, and in machine-formed fully-closed or sealed bags in the case of others. Although customers generally prefer the use of well known handle-incorporating bags for accommodating their purchases, in many cases they prefer that the, or at least some of the, purchased articles be packed in fully closed bags.

Because known automatic bagging machines can return, to the customer, the purchased goods in either closed bags, or handled bags, but not both, supermarkets and the like are constrained to make both types of bagging machines available to their customers. This requires a considerable investment by the supermarket for purchasing one or more of each of the various types of bagging machines, necessitates increased maintenance costs for servicing several different types of such machines, and wastes valuable retail space for the installation and accommodation of both types of machines. In addition, customers who wish some of their purchased articles to be packed in handled bags and others in closed bags must proceed through the checkout process twice, once using one type of bagging machine and again using the other.

OBJECTS AND SUMMARY OF THE INVENTION

It is accordingly the desideratum of the present invention to provide an automatic bagging machine for customer-purchased articles, for incorporation in the checkout counter of a supermarket or the like, in which the articles are packable, at the option of the customer or operator, in bags with handles or in closed bags. More particularly, it is an object of the present invention to provide apparatus for use in an automatic bagging machine to prepare, on demand and at the option of the customer or operator, either or both handled bags and fully-closed bags.

These and other objects are achieved, in accordance with the invention, in a die cutting and welding device for use in a packing or bagging or bag-forming machine and including a first mobile holder carrying one or more transverse welding plates, and a second mobile holder arranged substantially parallel to the first holder and carrying a welding counter-plate upon which is mounted a horizontal blade for the transverse cutting or separation of bags from, by way of example, a roll or continuous web of such bags or of bag-forming film or material. The second mobile holder also carries a plurality of blades for the longitudinal cutting and forming of bag handles. A bladeholder is interposed between the counter-plate and the second mobile holder, the bladeholder being linked for sliding and resilient or spring-loaded movement to the second mobile holder and being maintained at a fixed distance from the second holder by an operatively rotatable or pivotable spacer element that is selectively pivotable under user control for switching or shifting between machine production of handled bags, on the one hand, and of fully-closed bags, on the other. Such shifting of the spacer element may conveniently be effected by depression of an actuating pushbutton switch or the like conveniently located on the checkout counter within easy reach of the counter operator/cashier and/or customer.

The die cutting and welding device of the invention can readily be applied to and used in currently-available checkout counter automatic bagging machines. Thus, such bagging machines as are presently in use can advantageously be adapted to accommodate the inventive device and teachings and the resulting new functional ability to produce on-demand bags, and to pack purchased articles in the bags, which either incorporate integral handles for ease of transport or are fully-closed or sealed so as to prevent the inadvertent loss of articles from within the bags. The present invention offers the additional advantage that the differing needs and wishes of customers in respect of the bagging of purchased articles can be met by simply, for example, pushing an actuating button or switch that is conveniently located on the checkout counter within easy reach of the cashier and/or customer.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
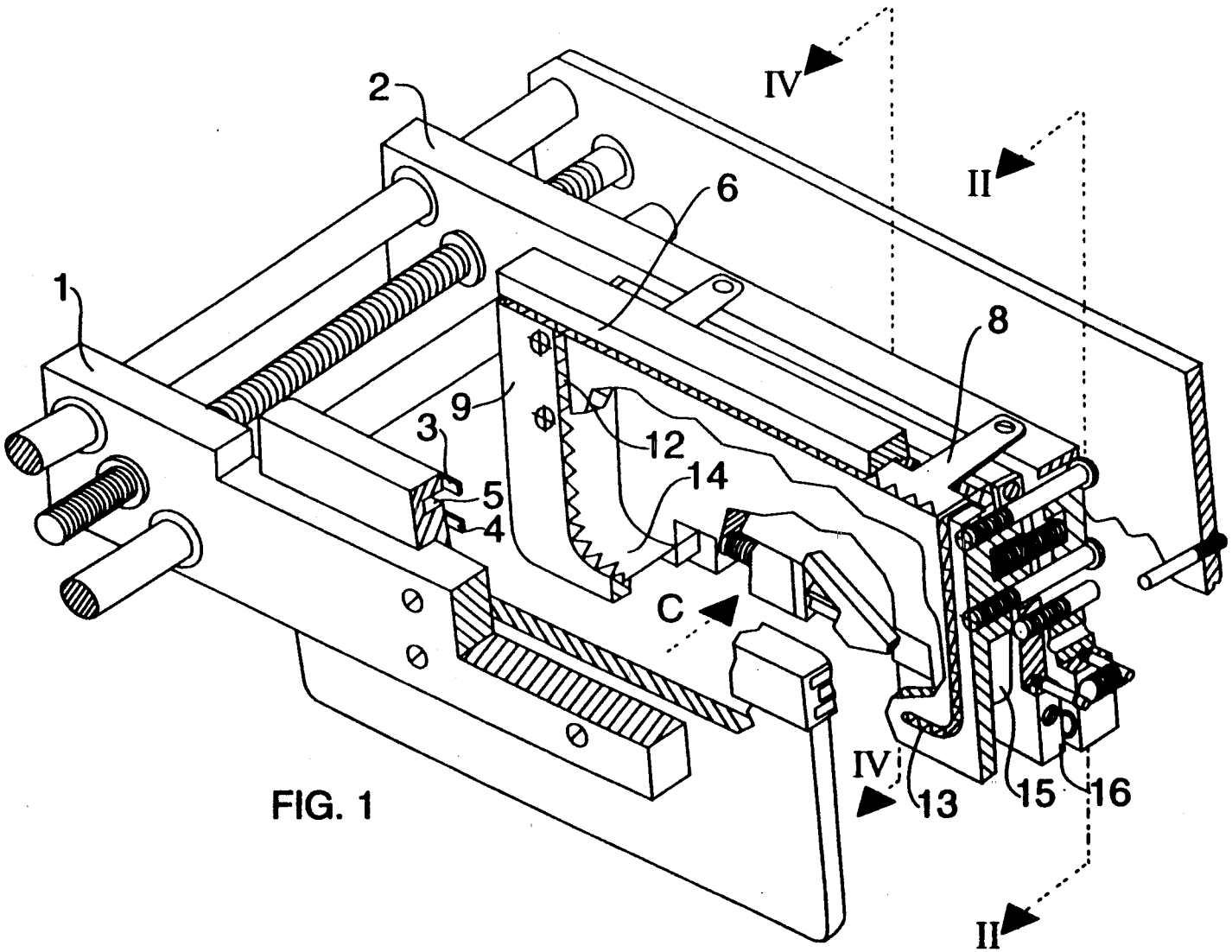
FIG. 1 is an elevated perspective view, partly in section and partly broken away, of a die cutting and welding device constructed in accordance with the teachings of the present invention.

With initial reference to FIG. 1, a die cutting and welding device constructed in accordance with the teachings of the present invention includes first and second mobile holders 1, 2 which are controlled, in a manner will known to those skilled in the art, by the automatic bagging or packing machine for reciprocating relative movement thereof. More particularly, the holders 1, 2 are controlledly movable relatively toward and away from one another while a tubular wrapper or web of material, from which individual bags are formed by transversely sealing at two locations to form the bottom and top of each bag, is longitudinally advanced between the opposed mobile holders. Toward this end, the first mobile holder 1 is provided with two substantially parallel transverse seal-forming welding plates 3, 4 that are separated by a notch 5. The second mobile holder 2 carries a counter-plate 9, to the upper side or top of which is fixed a counter-welding plate 6 disposed in opposition or facing relation to the welding plates 3, 4. A horizontal blade 8 secured to the holder 2 is accommodated in and protrudes through a slot 7 that is defined in the counter-welding plate 6. The blade 8 projects and extends into the notch 5 as the first and second mobile holders 1, 2 are brought relatively together after each bag sealing operation; in this manner the tubular film web between the two parallel transverse heat seals that have been formed in the web by the plates 3, 4 (so as to define the respective bottom and top of adjacently-formed bags) is cut and thereby separates, by way of example, a filled and completed bag from the just-created bottom of the next successive, and still empty, bag.

The counter-plate 9 is provided with a plurality of slots 12, 13 for accommodating the passage therethrough of blades, two being shown in the illustrated embodiment, of a die cutter which is operable to longitudinally cut the web at the upper end of an already-filled and sealed bag and thereby define unitary handles on the bag. For this purpose each of the slots 12, 13 is shaped and contoured in full correspondence to the corresponding blade 14, 15 of the die cutter. In the illustrated embodiment, the lower portions of these slots are gradually arcuate or curved, rather than sharply angled or rectilinear, so as to operatively form unitary handles that depend from the remainder of the bag along curved lines and edges that exhibit increased resistance to tearing and laceration and, accordingly, enhanced durability.

The blades 14, 15, which in the herein-disclosed form of the inventive apparatus are configured as substantial mirror-images of each other, are mounted to and proximate and depend from the transverse or lateral regions or edges of a moving bladeholder 16 that is interposed between the counter-plate 9 and the second mobile holder 2.

Figure 2:
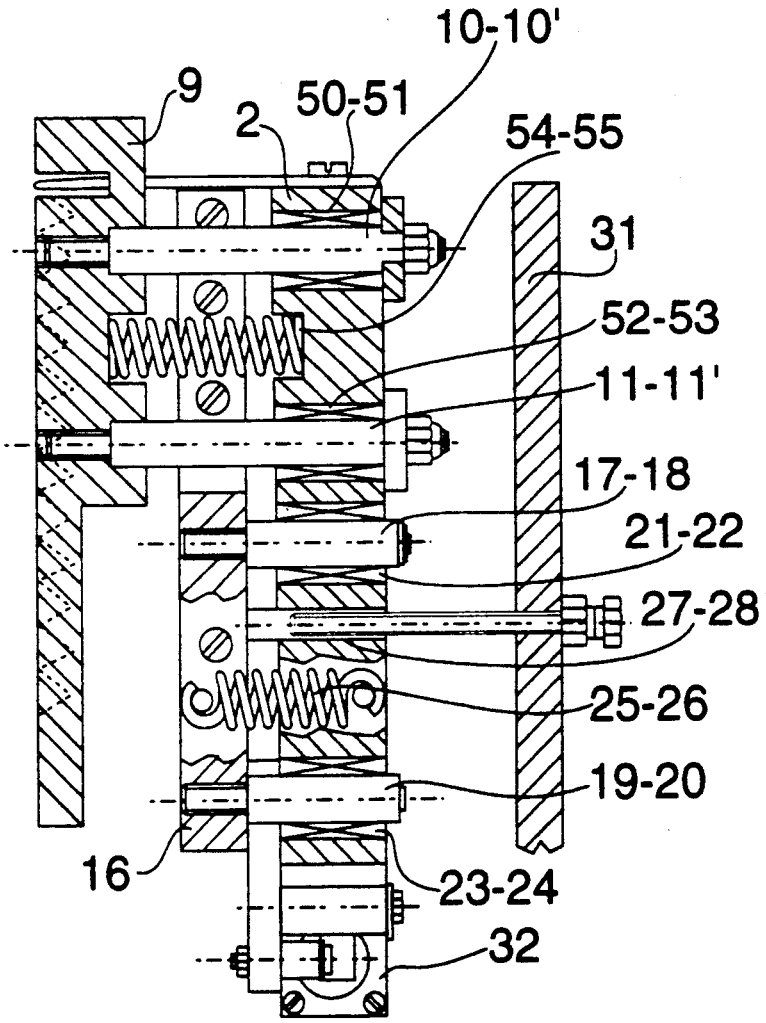
FIG. 2 is a sectional view taken along the lines II—II in FIG. 1.

As seen in FIG. 2, the bladeholder 16 is disposed in sliding relation to the second mobile holder 2 and, in this regard, carries four elongated pins 17, 18, 19, 20 secured to the bladeholder 16 and which are longitudinally slidable through apertures or through passages defined in the holder 2. In order to facilitate such sliding movement of the pins, each of these second mobile holder apertures is provided with an internal axial bearing 21, 22, 23, 24 through which a respective one of the pins 17, 18, 19, 20 is slidably journalled or receivable. The bladeholder 16 is also resiliently or elastically linked to the mobile holder 2 by return springs 25, 26 which normally urge the bladeholder 16 and mobile holder 2 relatively together.

The counter-plate 9 is relatively slidably associated with the second mobile holder 2. More particularly, in the illustrated embodiment a plurality of elongated pins 10, 10', 11, 11' are screwed or otherwise affixed at one of their ends to the counter-plate 9 and are positioned for sliding movement through apertures or through passages-each of which contains an axial bearing 50, 51, 52, 53 for facilitating such sliding movement of the pins-defined in the holder 2. The counter-plate 9 is also resiliently or elastically linked to the mobile holder 2 by compression springs 54, 55 that normally urge the counter-plate relatively away from the holder 2; each of the pins 10, 10', 11, 11' accordingly includes, at its end opposite that secured to the counter-plate 9 and disposed externally of the rear face of the holder 2, a radial projection of sufficient size to prevent entry of that pin end into and through the respective aperture and aperture bearing and, correspondingly, limiting the maximum separation or movement apart of the counter-plate 9 and mobile holder 2.

The second mobile holder 2 is also provided with an additional plurality of apertures or through passages 27, 28 with which elongated slide pins 29, 30, which pins are secured to a sidewall or frame member 31 of the bagging machine, are aligned. As the mobile holder 2 moves in its reciprocated relative approach to the first mobile holder 1, the slide pins 29, 30 move freely through the respective apertures 27, 28. The length of the pins 29, 30 is predeterminately selected so that the pin ends opposite or remote from the machine sidewall 31 contact the rear side or face of the moving bladeholder 16 when the mobile holder 2 is in its relatively opening motion and reaches a predetermined position proximate the sidewall 31.

FIG. 2 also depicts an electromagnet 32 that is carried on and proximate the lower portion of the second mobile holder 2. The electromagnet is, in a preferred form of the invention, operatively connected to a push-button switch (not shown) or the like which is selectively manually depressible or otherwise actuatable for operating the electromagnet for a purpose that will hereinafter be described.

Figure 3:
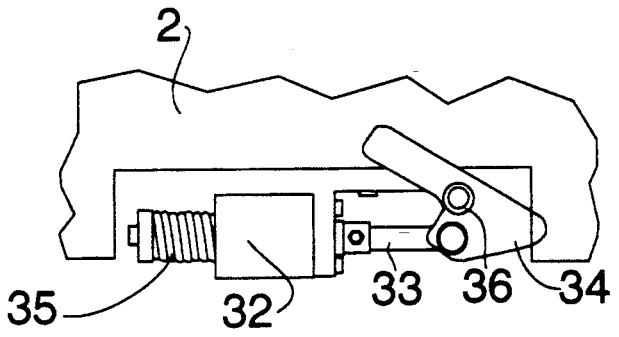
FIG. 3 is a partial section or detail of the device of FIG. 1 as viewed from the location and perspective of the arrow C in FIG. 1.

As further detailed in FIG. 3, the electromagnet 32 is linked, by a connecting rod 33, to a spacer element 34 that is mounted on an axle 36 for pivotal movement or rotation of the element 34 with or about the axle; thus, the axle 36 defines an axis about which the spacer element 34 is pivotally rotatable. A compression-type return spring 35 acts on the connecting rod 33 to normally—i.e. in the unactuated or nonenergized condition of the electromagnet 32—urge the connecting rod leftward (in FIG. 3) and thereby maintain the spacer element 34 in the diagonal or oblique position that is illustrated in FIG. 3. When the electromagnet 32 is energized, on the other hand, it displaces the connecting rod 33 longitudinally to the right (in FIG. 3), against the natural urgency of the spring 35, whereby the spacer element 34 pivots in the counterclockwise (in FIG. 3) direction and its outwardly extending, initially obliquely-oriented arm is shifted to or beyond a substantially horizontal position.

When the inventive device, and most especially the spacer element 34, is disposed in that state or condition illustrated in FIG. 3, the device functions as both a welder and a die cutter so that articles purchased by a customer are packed in bags that are formed with and include unitary handles. That is, with the elongated or extending armor like portion of the spacer element 34 in its raised or oblique orientation (FIG. 3), it reaches and contacts the rear face of the moving bladeholder 16, thereby preventing the bladeholder from moving closer to the machine sidewall 31 as the counter-plate 9 recedes or is withdrawn (to the right in FIG. 2) under the urgency of the welding plates 3, 4 during the maximum relative approach of the mobile holders 1, 2 in the course of packing machine operation. Thus, as the counter-plate 9 recedes, thereby compressing the springs 54, 55, corresponding movement of the bladeholder 16 is prevented by the spacer element 34 which maintains the bladeholder at a minimum distance or spacing from the mobile holder 2. The die cutter blades 14, 15 can then penetrate and pass through the respective slots 12, 13 until they protrude beyond the front face of the counter-plate 9 to form a closed bag with two arcuate, generally vertical cuts that define the unitary bag handles. The closed area or bag portion between the two resulting handles provides further protection against spillage or other loss of articles contained within the bag, while the handles assure the customer of maximum comfort and ease in carrying or otherwise transporting from the store the filled bag containing the customer's purchases.

When the customer determines to have his or her purchased articles packed in a fully-closed, handleless bag—as for example where the customer intends to entrust transport of the filled bag to a third party—the operator/cashier, or the customer, actuates the electromagnet 32 by, as is currently preferred but is not intended to be a limitation on the practice or implementation of the invention, depression of a pushbutton switch (not shown) or the like situated on the checkout counter or otherwise for ready access. When so actuated, the electromagnet 32 effects, through longitudinal displacement of the connecting rod 33, counterclockwise (in FIG. 3) pivotal rotation of the spacer element 34 about its axle 36 whereby the elongated spacer element arm is positionally shifted, from its FIG. 3-illustrated oblique position, to or beyond a substantially horizontal orientation.

As should by now be apparent, in the initial or unactuated or nonenergized condition of the electromagnet 32 the elongated arm or like portion of the spacer element 34 is pressed, along its opposite faces, between the moving bladeholder 16 and the second mobile holder 2. The present invention provides a mechanical arrangement to assist in the pivotal rotation of the spacer element 34 from its FIG. 3 position by releasing this pressed engagement of the spacer element arm. This arrangement is implemented by the elongated slide pins 29, 30 which are secured to the machine sidewall 31 and are slidably moveable through the apertures 27, 28 until the free ends of the pins 29, 30 contact the rear face of the bladeholder 16 just before the mobile holder 2 reaches its fully or maximally-opened position—i.e. the position of closest approach of the holder 2 to the machine sidewall 31. In this fully-opened position, the unsecured ends of the pins 29, 30 press against the rear face of the moving bladeholder 16 and forcibly move it at least very slightly away from the mobile holder 2.

Figure 4:
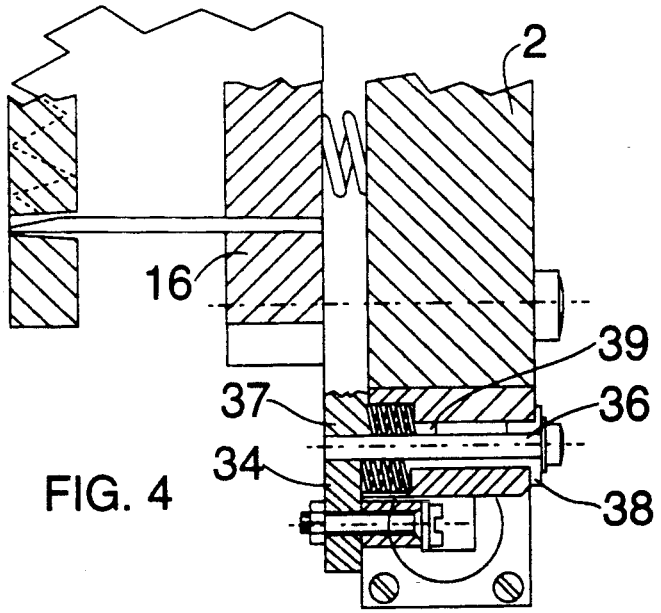
FIG. 4 is a sectional view taken along the lines IV—IV in FIG. 1.

The arrangement for assisting in pivotal rotation of the spacer element 34 further includes, as seen in FIG. 4, bushings 38, 39 through which the axle 36 is journalled for rotation and limited axial movement, and cup springs 37. Since in the illustrated embodiment the axle 36 is secured at one end to the spacer element 34, the cup springs 37 normally longitudinally urge the axle 36 and spacer element 34 to the left (in FIG. 4), i.e. away from the mobile holder 2. Thus, in the fully-opened position of the holder 2, the cup springs 37 resiliently move the spacer element 34 at least very slightly away, into spaced relation with, the mobile holder 2; in the disclosed embodiment of the invention, this spacing between the spacer element 34 and mobile holder 2 is less than the spacing between the spacer element and the bladeholder 16 that results from contact of the slide pins 29, 30 with the bladeholder. In any event, by virtue of the resulting spacing on both sides of the spacer element 34, that element is no longer pressed between the bladeholder 16 and mobile holder 2 and is therefore freely pivotally rotatable when actuated by the electromagnet 32. To energize the electromagnet 32 and thereby effectuate pivotal rotation of the spacer element 34, therefore, it is appropriate to depress the actuating pushbutton or the like during the interval between two transverse sealing operations—that is, when the mobile holders 1, 2 are in their fully or maximally-opened positions.

With energization of the electromagnet, the spacer element 34 is pivoted in the counterclockwise sense (in FIG. 3) so that its elongated arm or like portion is displaced to or beyond a substantially horizontal orientation. In this pivoted or displaced condition of the element 34, its elongated (and now substantially horizontal) arm is no longer positioned for contact with the bladeholder 16. The bladeholder can accordingly retract—i.e. move into substantial abutment with the mobile holder 2—under the resilient urgency of the return springs 25, 26 during the next subsequent sealing operation so that die cutting or forming of the handles of the just-sealed bag does not occur. The resulting article-filled bag thus remains fully closed and handleless for increased security and prevention of inadvertent or unintended article loss or removal from the sealed bag.

After sealing of the bag has been completed, the mobile holder 2 moves relatively away from the mobile holder 1 and, when it reaches its fully or maximally-open position, the free ends of the pins 29, 30 once again press against the bladeholder 16 in opposition to the normal urgency and effect of the return springs 25, 26. In this manner there is maintained between the bladeholder 16 and mobile holder 2 sufficient space for passage of a portion, such as the elongated arm, of the spacer element 34. Accordingly, under the urgency of the return spring 35 and resulting displacement of the connecting rod 33 the spacer element is pivotally returned, through clockwise (in FIG. 3) rotation of the element 34, to the raised or oblique orientation in which the arm or other portion of the spacer element is once again interposed between the bladeholder 16 and mobile holder 2. This restores the die cutting functionality and operation of the apparatus for forming bag handles since the moving bladeholder is once again prevented by the spacer element 34 from moving into abutment with the counter-plate 9, and the die cutter blades 14, 15 thus protrude outwardly from their respective slots 12, 13 and make the handle-defining cuts on the closed and article-filled bag. A handled bag is thereby formed by and in association with the inventive apparatus.

Although the die cutter blades 14, 15 are shown in the drawings as being boltedly secured to and proximate opposite transverse edges of the bladeholder 16, the blades may alternatively be mounted on the bladeholder in any other way and position suitable for carrying out their disclosed and intended functionality. Likewise, the return spring 35 that functions in the illustrated embodiment, in conjunction with the connecting rod 33 and electromagnet 32, to normally maintain the FIG. 3 position of the spacer element 34 may be replaced by, for example, a different spring or resilient member or the like that acts directly on the spacer element, such as on its elongated arm or like portion, to effectuate pivotal rotation of the spacer element in the same or in the opposite rotative sense as that described in connection with the herein-disclosed implementation of the invention. It should thus be recognized that these and numerous other structural are functional modifications to elements and assemblies shown and described in this specification are fully within the intended scope and contemplation of the present invention.

Accordingly, while there have been shown and described and pointed out fundamental novel features of the invention as applied to a preferred embodiment thereof, it will be understood that various omissions and substitutions and changes in the form and details of the device illustrated, and in its operation, may be made by those skilled in the art without departing from the spirit of the invention. It is the intention, therefore, to be limited only as indicated by the scope of the claims appended hereto.

What is claimed is:

1. A welding and die cutting device for an apparatus for automatically forming bags from an elongated web of film, comprising:

a first (1) and a second (2) mobile holder disposed for relative movement toward and away from each other;

a welding counter-plate (9) carried by said second mobile holder (2);

a horizontal blade (8) on the counter-plate for transversely cutting the film web to separate a formed bag from the web;

a second blade (14, 15) for longitudinally cutting handles in a bag being formed;

a bladeholder (16) interposed between said counter-plate (9) and said second mobile holder (2) and from which said second blade (14, 15) depends;

means (17, 18, 19, 20, 25, 26) slidably and elastically linking said bladeholder (16) and said second mobile holder (2); and a pivotally rotatable spacer element (34) selectively movable between a first position for maintaining a predeterminately spaced relation between said bladeholder (16) and said second mobile holder (2) and a second position in which said bladeholder and second mobile holder are relatively movable into substantial abutment.

2. A welding and die cutting device in accordance with claim 1, wherein said means comprises an aperture defined in said second mobile holder (2), an elongated pin (17, 18, 19, 20) depending from said bladeholder (16) and aligned with said aperture for slidable receipt of said pin in said aperture as the bladeholder moves relative to said second mobile holder, and a return spring (25, 26) elastically connecting said bladeholder (16) and said second mobile holder (2).

3. A welding and die cutting device in accordance with claim 1, further comprising an axle (36) defining an axis about which said spacer element (34) is pivotally movable, an electromagnet (32) connected to said spacer element and operable for pivotally rotating said spacer element between said first and second positions in a first rotative sense, and a return spring (35) for pivotally rotating said spacer element between said first and second positions in a second rotative sense opposite said first sense.

4. A welding and die cutting device in accordance with claim 3, further comprising a connecting rod (33) connecting said electromagnet (32) and said spacer element (34) and movable by operation of said electromagnet (32) for effecting said pivotal rotation of said spacer element between said first and said second positions in said first rotative sense.

5. A welding and die cutting device in accordance with claim 4, wherein said return spring (35) is coupled to said connecting rod (33) for normally urging said spacer element (34) to rotate between said first and second positions in said second rotative sense and thereby effecting a return pivotal movement of the spacer element in said second rotative sense after said electromagnet is operated to rotate said spacer element in said first rotative sense.

6. A welding and die cutting device in accordance with claim 1 and wherein the bag-forming apparatus includes a frame member (31), said welding and die cutting device further comprising separating means for facilitating said pivotal movement of the spacer element (34) from said first to said second position by separating said bladeholder (16) from said second mobile holder (2) by a predetermined spacing, said separating means comprising an elongated pin (10, 11) depending from the apparatus frame member (31) and having a length selected for abutment of said pin with said bladeholder (16) as said second mobile holder (2) attains a predetermined position in said relative movement of said first and second mobile holders (1,2) such that said abutment of said pin (10, 11) with said bladeholder (16) effects movement of said bladeholder relatively away from said second mobile holder (2).

7. A welding and die cutting device in accordance with claim 2 and wherein the bag-forming apparatus includes a frame member (31), said welding and die cutting device further comprising separating means for facilitating said pivotal movement of the spacer element (34) from said first to said second position by separating said bladeholder (16) from said second mobile holder (2) by a predetermined spacing, said separating means comprising a second elongated pin (10, 11) depending from the apparatus frame member (31) and having a length selected for abutment of said second pin with said bladeholder (16) as said second mobile holder (2) attains a predetermined position in said relative movement of said first and second mobile holders (1, 2) such that said abutment of said second pin (10, 11) with said bladeholder (16) effects movement of said bladeholder relatively away from said second mobile holder (2).

8. A welding and die cutting device in accordance with claim 3 and wherein the bag-forming apparatus includes a frame member (31), said welding and die cutting device further comprising separating means for facilitating said pivotal movement of the spacer element (34) from said first to said second position by separating said bladeholder (16) from said second mobile holder (2) by a predetermined spacing, said separating means comprising an elongated pin (10, 11) depending from the apparatus frame member (31) and having a length selected for abutment of said pin with said bladeholder (16) as said second mobile holder (2) attains a predetermined position in said relative movement of said first and second mobile holders (1, 2) such that said abutment of said pin (10, 11) with said bladeholder (16) effects movement of said bladeholder relatively away from said second mobile holder (2).

9. A welding and die cutting device in accordance with claim 4 and wherein the bag-forming apparatus includes a frame member (31), said welding and die cutting device further comprising separating means for facilitating said pivotal movement of the spacer element

(34) from said first to said second position by separating said bladeholder (16) from said second mobile holder (2) by a predetermined spacing, said separating means comprising an elongated pin (10, 11) depending from the apparatus frame member (31) and having a length selected for abutment of said pin with said bladeholder (16) as said second mobile holder (2) attains a predetermined position in said relative movement of said first and second mobile holders (1, 2) such that said abutment of said pin (10, 11) with said bladeholder (16) effects movement of said bladeholder relatively away from said second mobile holder (2).

10. A welding and die cutting device in accordance with claim 5 and wherein the bag-forming apparatus includes a frame member (31), said welding and die cutting device further comprising separating means for facilitating said pivotal movement of the spacer element (34) from said first to said second position by separating said bladeholder (16) from said second mobile holder (2) by a predetermine spacing, said separating means comprising an elongated pin (10, 11) depending from the apparatus frame member (31) and having a length selected for abutment of said pin with said bladeholder (16) as said second mobile holder (2) attains a predetermined position in said relative movement of said first and second mobile holders (1, 2) such that said abutment of said pin (10, 11) with said bladeholder (16) effects movement of said bladeholder relatively away from said second mobile holder (2).

11. A welding and die cutting device for an apparatus for automatically forming bags from an elongated web of film, comprising:

a first (1) and a second (2) mobile holder disposed for relative movement toward and away from each other;

a welding counter-plate (9) carried by said second mobile holder (2);

a horizontal blade (8) on the counter-plate for transversely cutting the film web to separate a formed bag from the web;

a second blade (14, 15) for longitudinally cutting handles in a bag being formed;

a bladeholder (16) interposed between said counter-plate (9) and said second mobile holder (2) and from which said second blade (14, 15) depends;

means (19, 20, 21, 22, 25, 26) slidably and elastically linking said bladeholder (16) and said second mobile holder (2);

a pivotally rotatable spacer element (34) selectively movable between a first position for maintaining a predeterminately spaced relation between said bladeholder (16) and said second mobile holder (2) and a second position in which said bladeholder and second mobile holder are relatively movable into substantial abutment;

an electromagnet (32) connected to said spacer element (34) and actuatable for pivotally moving said spacer element from one of said first and second positions to the other of said first and second positions; and a return spring (35) for pivotally moving said spacer element from said other of said first and second positions to said one of said first and second positions.

12. A welding and die cutting device in accordance with claim 11 and wherein the bag-forming apparatus includes a frame member (31), said welding and die cutting device further comprising separating means for facilitating said pivotal movement of the spacer element (34) from said first to said second position by separating said bladeholder (16) from said second mobile holder (2) by a predetermined spacing, said separating means comprising an elongated pin (10, 11) depending from the apparatus frame member (31) and having a length selected for abutment of said pin with said bladeholder (16) as said second mobile holder (2) attains a predetermined position in said relative movement of said first and second mobile holders (1, 2) such that said abutment of said pin (10, 11) with said bladeholder (16) effects movement of said bladeholder relatively away from said second mobile holder (2).

13. A welding and die cutting device for an apparatus for automatically forming bags from an elongated web of film and operable for selectively forming handles on bags being formed the apparatus, comprising:

a first (1) and a second (2) mobile holder disposed for relative movement toward and away from each other;

a welding counter-plate (9) carried by said second mobile holder (2);

a horizontal blade (8) on the counter-plate for transversely cutting the film web to separate a formed bag from the web;

a second blade (14, 15) for longitudinally cutting handles in a bag being formed;

a bladeholder (16) interposed between said counter-plate (9) and said second mobile holder (2) and from which said second blade (14, 15) depends;

means (17, 18, 19, 20, 25, 26) relatively movably linking said bladeholder (16) and said second mobile holder (2);

a pivotally rotatable spacer element (34) selectively movable between a first position in which said spacer element is interposed between said bladeholder and said second mobile holder so as to maintain a predeterminately spaced relation between said bladeholder (16) and second mobile holder (2) and thereby enable said second blade to project outwardly beyond said counter-plate for handle-forming contact with the film web to form a handle in a bag being formed, and a second position in which said spacer element (34) is moved out of said interposed relation between said bladeholder and said second mobile holder so that said bladeholder and second mobile holder are relatively movable into substantial abutment in which said projection of the second blade beyond said counter-plate for handle-forming contact with the film web is prevented and no handle is thereby formed in a bag being formed.

* * * * *